US005593546A

United States Patent [19]

Ilvespääet al.

[11] Patent Number: 5,593,546

[45] Date of Patent: Jan. 14, 1997

[54] HYBRID FORMER WITH AN MB UNIT IN A PAPER MACHINE

[75] Inventors: Heikki Ilvespää, Jyväskylä; Jyrki Jaakkola, Korpilahti; Ari Linsuri, Muurame; Erkki Partanen; Lauri Verkasalo, both of Jyväskylä, all of Finland

[73] Assignee: Valmet Corporation, Helsinki, Finland

[21] Appl. No.: 439,514

[22] Filed: May 11, 1995

[51] Int. Cl.[6] ..... D21F 1/00

[52] U.S. Cl. ..... 162/301; 162/300

[58] Field of Search ..... 162/300, 301, 162/352, 351

[56] References Cited

U.S. PATENT DOCUMENTS

| | | | |
|---|---|---|---|
| 4,414,061 | 11/1983 | Trufitt et al. | 162/301 |
| 4,557,802 | 12/1985 | Waris | 162/301 |
| 4,714,521 | 12/1987 | Fujiwara | 162/301 |
| 4,988,408 | 1/1991 | Evalahti | 162/301 |
| 5,185,064 | 2/1993 | Nyman | 162/301 |
| 5,215,628 | 6/1993 | Koivuranta et al. | 162/301 |
| 5,282,933 | 2/1994 | Bubik et al. | 162/301 |
| 5,395,484 | 3/1995 | Odell et al. | 162/203 |

FOREIGN PATENT DOCUMENTS

| | | |
|---|---|---|
| 0486814 | 5/1992 | European Pat. Off. . |
| 0552139 | 7/1993 | European Pat. Off. . |
| 0627524 | 12/1994 | European Pat. Off. . |
| 90572 | 3/1989 | Finland . |
| 893164 | 6/1989 | Finland . |
| 885607 | 6/1990 | Finland . |
| 905447 | 5/1992 | Finland . |
| 924289 | 9/1992 | Finland . |
| 88057 | 12/1992 | Finland . |
| 931951 | 4/1993 | Finland . |
| 932265 | 5/1993 | Finland . |
| 932793 | 6/1993 | Finland . |
| 91092 | 1/1994 | Finland . |
| 91173 | 2/1994 | Finland . |
| 9312292 | 6/1993 | WIPO . |

*Primary Examiner*—Karen M. Hastings

*Attorney, Agent, or Firm*—Steinberg, Raskin & Davidson, P.C.

[57] ABSTRACT

A hybrid former in a paper machine including a lower-wire loop in which there is an initial single-wire portion of a forming zone. In this initial portion, there are draining elements inside the lower-wire loop and thereafter wire-guide and draining elements. The former includes an upper-wire unit in which an upper wire is guided by guide rolls and by a breast roll onto a pulp layer formed on the single-wire portion of the lower wire. In a subsequent twin-wire portion following the single-wire portion, there is a draining and forming unit which includes at least one pressure-loaded press unit and at least one draining-chamber and support unit, which units are arranged inside opposite wire loops. In the units, there are sets of ribs which are pressure-loaded against each other. At the beginning of the twin-wire portion, inside the lower-wire loop, there is a revolving guide and forming roll which is in tangential contact with the lower wire or curves the twin-wire portion at a small angle which is in a range from about 0° to about 5°. The guide and forming roll is substantially immediately followed by the draining and forming unit which includes the sets of ribs. In the area of the draining and forming unit, water is drained primarily through the upper wire while aided by the negative pressures in the draining chamber or chambers in the unit.

20 Claims, 3 Drawing Sheets

HYBRID FORMER WITH AN MB UNIT IN A PAPER MACHINE

BACKGROUND OF THE INVENTION

The present invention relates to a hybrid former in a paper machine which comprises a lower-wire loop in which there is an initial single-wire portion of a forming zone including draining elements and wire-guide and draining elements arranged after the draining elements inside the lower-wire loop, and an upper-wire unit in which there is an upper wire which is guided by guide rolls and a breast roll onto the pulp layer that is formed on the initial single-wire portion of the lower wire. In the former, in a subsequent twin-wire portion of the forming zone formed after the initial single-wire portion between the lower-wire loop and the upper-wire loop, there is a draining and forming unit which comprises at least one pressure-loaded press unit and a draining-chamber and at least one support unit which units are placed in opposite wire loops. In the support unit(s), there are sets of ribs which can be loaded against each other by applying pressure.

In web former sections in paper machines, several different forming members are used. The primary objective of these members is to produce a compression pressure and pressure pulsation in the fiber layer that is being formed. By means of this pressure and pulsation, the draining of water out of the web that is being formed is promoted while the formation of the web is improved. The forming members include various forming shoes which are usually provided with a curved ribbed deck and over which the forming wires placed one above the other and the web placed between the wires are curved. In the area of these forming shoes, water is drained through the wire placed at the side of the outside curve because of its tensioning pressure, and this draining is aided further by a field of centrifugal force. Water is also drained through the wire placed at the side of the inside curve, which draining is typically intensified by means of a vacuum present in the chamber of the forming shoe. The ribbed deck of the forming shoe produces pressure pulsation which both promotes the draining and improves the formation of the web.

Further, in the prior art, so-called MB units are known, through which two opposite wires run generally in a straight run. In the prior art MB units, inside the loop of one of the wires, there is a pressure loading unit, and inside the loop of the other wire, a draining unit is arranged including a set of guide and draining ribs. As known from the prior art, the MB unit is placed in the fourdrinier wire portion so that the MB unit is preceded by a single-wire portion of considerable length in which a substantial amount of draining takes place before the web runs as a straight run, in the plane of the fourdrinier wire, through the MB unit. With respect to the details of construction of the prior art MB units, reference is made, by way of example, to the assignee's Finnish Patent Application Nos. 884109 and 885607 (corresponding to U.S. Pat. Nos. 5,185,004 and 4,988,408, respectively, the specifications of which are hereby incorporated by reference herein).

From the prior art, a number of different hybrid formers and twin-wire formers are known which are provided with a MB unit or MB units described above. With respect to such formers, reference is made to the following Finnish Patent Applications: 884109, 885608, 904489, 905447, 920228, 920863, 924289, 931950, 931951, 931952, 932265 and 932793. FI 885608, FI 932265 and FI 932793 correspond to U.S. patent application Ser. Nos. 07/442,013, abandoned 08/246,176 pending and 08/262,138, respectively, the specifications of which are hereby incorporated by reference herein. FI 9044.89 and FI 920228 correspond to U.S. Pat. Nos. 5,215,628 and 5,395,484, respectively, the specifications of which are hereby incorporated by reference herein.

Moreover, closely related to the present invention is the hybrid former described in International Patent Application WO 93/12292, in the name of J. M. Voith GmbH, in which former in the beginning of the twin-wire zone after the single-wire initial portion, there is a forming shoe inside the lower-wire loop which produces pressure pulsation in the stock web that has been formed on the lower wire.

The inlet geometry of the initial portion of the twin-wire forming zone has proved a highly critical point in the use of MB forming units. At the inlet of the twin-wire zone, the static forming shoes employed inside the lower-wire loop may cause instability in the running of the wires and, as a result, streaks in the finished paper are produced. Further, the initial portion of the twin-wire zone in the MB unit has a substantial effect, e.g., on the porosity of paper. The inlet area of the twin-wire zone is problematic in particular because at this point, when the upper wire reaches contact with the top face of the pulp web that is being formed, the fiber structure of the pulp web "freezes", whereby the unevenness present in this area on the top face of the pulp layer is seen as streaks in the finished paper. Thus, the pressure pulses of the static forming shoe produce wave formation in the top face of the web, which waves, having "frozen" in their position, are seen as these streaks. Further drawbacks of the static and stationary forming shoes are their quite high friction as well as the wire-wearing effect.

OBJECTS AND SUMMARY OF THE INVENTION

Accordingly, it is an object of the present invention to further develop the prior art constructions shown in the above-mentioned patents and publications as well as to provide a hybrid former which makes use of an MB unit and in which the drawbacks discussed above can be largely avoided.

It is a further object of the invention to provide a hybrid former provided with an MB unit by whose means a paper web can be produced that is as symmetric as possible in respect of its distribution of fines and fillers and in respect of both of its opposite faces, also in respect of printing properties.

In view of achieving the objects stated above and others, in the invention, at the beginning of the twin-wire forming zone inside the lower-wire loop, a revolving guide and forming roll is arranged which is in tangential contact with the lower wire or curves the twin-wire zone at a small angle a, which angle is selected in the range of from about 0° to about 5°. When the angle is 0°, the guide and forming roll is in tangential contact with the lower wire. The guide and forming roll is substantially immediately followed by the draining and forming unit which comprises sets of ribs and in whose area water is drained primarily through the upper wire while aided by the negative pressures present in the draining chamber or chambers in the unit.

In accordance with the invention, when a forming roll that contacts or guides the lower wire is arranged inside the lower-wire loop in the inlet area of the twin-wire portion or zone placed before the MB unit, the area of the inlet gap of the twin-wire zone can be made more stable so that neither harmful wave formation occurs in this zone nor resulting streaks are present in the finished paper. Moreover, the forming roll guides the lower wire also in the cross direction in a more stable way than the corresponding prior art stationary forming shoe does. At the trailing side of the forming roll, water is drained through the lower wire merely by the table-roll effect in itself known. The covering angle a on the forming roll that curves the lower wire is typically in a range of from about 0° to about 5°, preferably in a range of from about 0° to about 2°, for it is possible to stabilize the run of the lower wire even with very small curve angles of the wire.

The forming roll may either be smooth-faced or have an open hollow face. When an open roll face is used, it is favorably possible to employ a covering angle a that is, on the average, slightly larger. A revolving forming roll that is arranged in accordance with the invention is preferable to a corresponding static forming shoe that rubs against the wire, and does not move, also in the respect that between the revolving face of the forming roll and the inner face of the lower wire, no abrasion is formed that consumes energy and abrades the faces. Thus, the constant rotational movement of the forming roll eliminates frictional contact between a stationary curved ribbed deck and the wire.

It is an important feature of the invention that the stock web is subjected to the dewatering taking place by means of the suction boxes in the MB unit while still as wet as possible, so that a maximum proportion of water is removed upward through the upper wire, the objective being to provide the web with a distribution of fines and fillers as symmetric as possible. Thus, at the forming roll, the inlet consistency $k_1$ of the stock web at the twin-wire zone has been arranged to be in the range of from about 1 to about 3% preferably from about 1.5 to about 2.5%, in which case the proportion of draining taking place through the upper wire can be made sufficiently high in view of the objectives described above. After the MB unit, the consistency of the stock web is of an order of $k_2$ from about 14% to about 19%, depending on the paper grade.

The roll diameter of the forming roll Do at the inlet of the twin-wire zone is, for example, with a machine of a width of 10 meters, from about 800 mm to about 1000 mm, in which case a sufficiently small deflection is provided for the roll. In a preferred embodiment of the roll, it is possible to use a variable-crown or adjustable-crown roll as the forming roll. When a variable-crown or adjustable-crown roll is used, the diameter of the roll can be considerably smaller than the example provided above, the diameter being typically from about 400 mm to about 500 mm.

In the following, the invention will be described in detail with reference to some exemplifying embodiments of the invention illustrated in the figures in the accompanying drawing. However, the invention being by no means strictly confined to the details of these embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
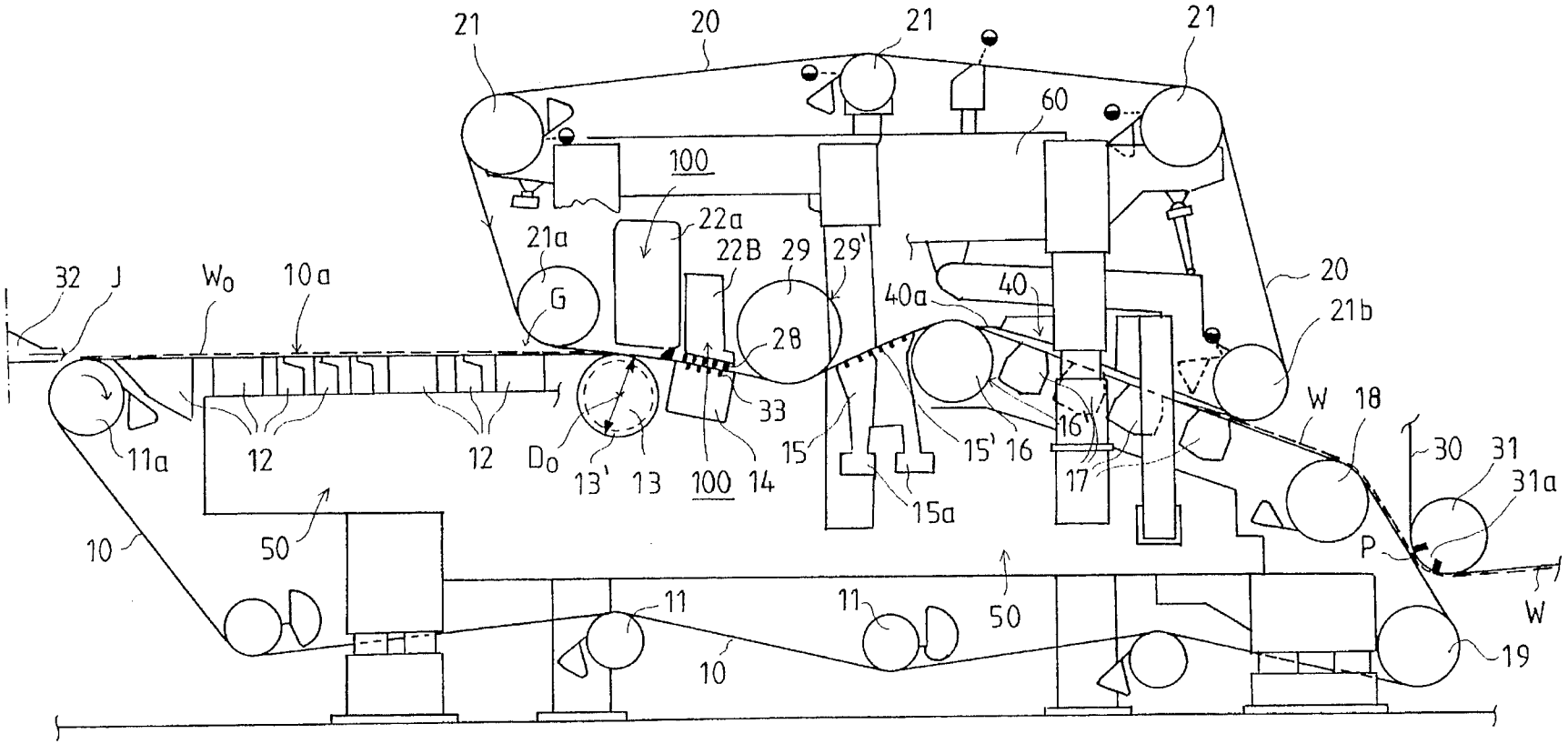
FIG. 1 is a schematic side view of an overall concept of a hybrid former in accordance with the invention.

Referring to the accompanying drawings wherein like reference numerals refer to the same or similar elements, FIG. 1 shows a hybrid former having the basic construction of a former marketed by the assignee with the trademark "Sym-Former". The former as shown in FIG. 1 is also suitable for modernizations of fourdrinier wire parts in which case a loop of a lower wire 10 with its frame 50 consists of the existing construction, and the existing fourdrinier wire part has been modernized by means of a new upper-wire unit constructed on support of a frame part 60. The former shown in FIG. 1 may also be a new construction.

In the hybrid former shown in FIG. 1, the lower wire 10 is guided in its loop by guide rolls 11, and a pulp suspension jet J is fed through a slice part 32 of the headbox to the location of a breast roll 11*a* to the beginning of a horizontal fourdrinier wire portion 10*a* to form a web $W_0$ thereon. There are draining elements 12 in themselves known situated in the wire portion 10*a*. The twin-wire zone, which is defined between the lower wire 10 and an upper wire 20, starts after the initial single-wire portion 10*a* at a breast roll 21*a* having a smooth-face 21*a*' which is situated in the loop of the upper wire. In accordance with the invention, a guide and forming roll 13 is arranged inside the loop of the lower wire 10 after the twin-wire zone has started and in the following, for the sake of conciseness, is designated simply as a "forming roll". In the twin-wire zone, the forming roll 13 is followed by an MB unit 100 in which there is a pressure loading unit 14 inside the loop of the lower wire 10 and a suction-deflector chamber 22A and a draining chamber 22B subjected to a vacuum, which are arranged inside the loop of the upper wire 20. Underneath the chamber 22B, a set of support ribs 28 is arranged against which ribs the twin-wire zone is pressed by a set of loading ribs 33 arranged in the pressure loading unit 14.

After the MB unit 100, a forming roll 29 having a smooth-face 29' is arranged inside the upper-wire loop and curves the twin-wire zone is curved from a downward, inclined run before forming roll 29 to an upward, inclined run after forming roll 29. After forming roll 29, inside the lower-wire loop 10, there is a forming shoe 15 which has a ribbed deck 15' having a large curve radius. The forming shoe 15 is connected to a vacuum, e.g., by means of suction legs 15*a*. The forming shoe 15 is followed by a forming roll 16 having a smooth-face 16' arranged inside the loop of the lower wire 10 and which serves to alter the direction of the twin-wire zone from its upward, inclined run to a downward, inclined run. At the trailing side of forming roll 16, there is a water collecting trough 40 resting on the frame part 60 of the upper-wire unit and a water-collecting and water-guide plate 40*a* of the trough 40. After this, the twin-wire zone continues in a downward, inclined zone in which, inside the loop of the lower wire 10, there are suction boxes 17. At the last one of the suction boxes, the upper wire 20 is guided by a guide roll 21*b* to be separated from the paper web W. The web W is separated from the lower wire at a pickup point P situated between rolls 18 and 19 and is transferred, with the aid of a suction zone 31*a* of a pick-up roll 31, onto a pick-up fabric 30 which carries the web W to the press section (not shown).

Figures 2, 2A:
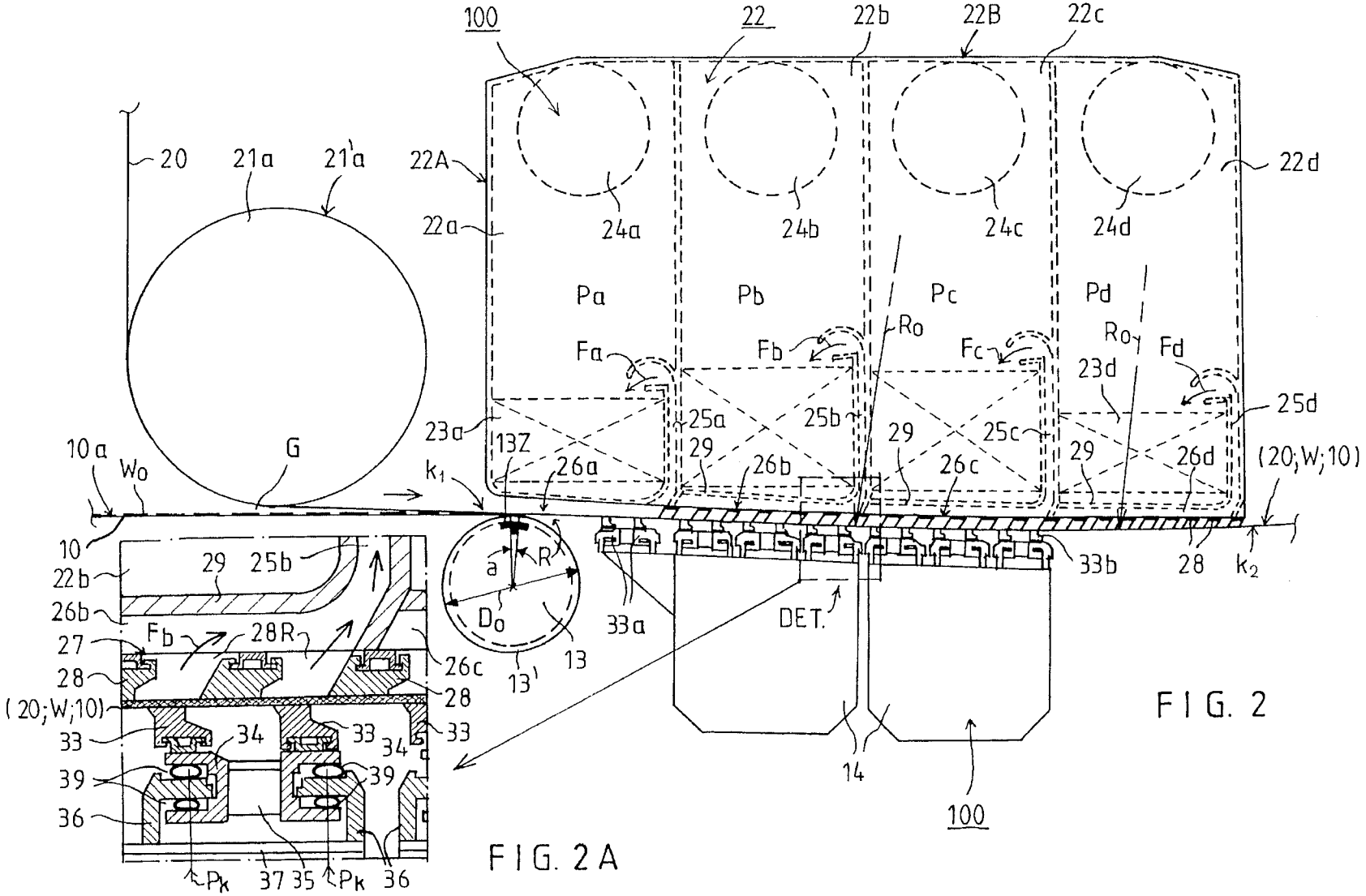
FIG. 2 is a central vertical sectional view in the machine direction of the initial part of the twin-wire zone and of the MB unit in a former in accordance with the invention.
FIG. 2A is a vertical sectional view in the machine direction of the detail DET bordered by the dashed line in FIG. 2.

A preferred MB unit 100, which is shown in FIGS. 2 and 2A, comprises a set of dewatering chambers 22 whose front side is connected with a suction-deflector unit 22A in which there is a preliminary dewatering chamber 22*a*. From this preliminary chamber 22*a*, a draining duct 23*a* is passed to the wire pit at the driving side of the machine. A suction-deflector duct 25*a* is passed to the preliminary chamber 22*a*. Through the duct 25*a*, a substantial amount of water is removed in the direction of the arrow $F_a$, aided by the compression between the wires 10,20 and by negative pressure $P_a$ present in the preliminary chamber 22*a* as well as by the effect of the kinetic energy of the water.

As shown in FIG. 2, the set of dewatering chambers 22 has been divided into three separate compartments 22*b*, 22*c* and 22*d* by means of vertical partition walls. The set of chambers 22 has outer walls in the cross direction and end walls in the machine direction. The end walls at the driving side of the machine are connected with the water drain ducts 23*b*, 23*c* and 23*d*. The compartments 22*b*, 22*c* and 22*d* are defined from below by the walls 29. Below walls 29, there are rib blocks 26*b*, 26*c* and 26*d* which open into gap spaces 28R between the stationary dewatering and support ribs 28.

As shown in FIGS. 2 and 2A, opposite to the set of support ribs 28, the loading unit 14 of the MB unit 100 operates. On a frame part 37 of the loading unit 14, loading ribs 33 are supported by the intermediate of pressure hoses 39 and are interconnected in pairs by means of intermediate parts 35. The pressure hoses 39 operate in pairs in the spaces between support parts 34 and 36. The outside support parts 36 are fixed to the frame constructions 37 of the unit 14. The first pair of ribs in the set of loading ribs 33 is denoted by reference numeral 33*a*, and the last rib is denoted by reference numeral 33*b*. The support ribs 28 and the loading ribs 33*a*,33, 33*b* are arranged alternatingly against one another (not directly opposite to one another) to extend across the entire width of the wires 10,20 in the cross direction. The set of loading ribs 33 is loaded against the inner face of the lower wire 20 by means of separately adjustable pressures $P_k$ of a pressure medium passed into the hoses 39.

The twin-wire zone runs in a gentle wave-like path guided by and between the sets of ribs 28 and 33*a*,33,33*b* preferably with a large curve radius $R_0$ or even substantially straight. The curve radius $R_0$ is selected preferably in the range of from about 5 m to about 8 m. The curve form $R_0$ of the twin-wire zone promotes the stable run of this zone.

Each of the compartments 22*a*,22*b*,22*c* and 22*d* communicates through a respective duct 24*a*,24*b*,24*c*,24*d* with a vacuum source, such as a suction pump, so that the level of the negative pressure $P_a$,$P_b$,$P_c$,$P_d$ present in each compartment 22*a*,22*b*,22*c*,22*d* can be independently regulated, or at least provided with a basic setting. Preferably, the negative pressures $P_a, \ldots, P_d$ are selected or set in a range from about 5 kPa to about 15 kPa.

By means of the loading ribs 33*a*,33,33*b*, the lower wire 10 is pressed both against the web W and against the upper wire 20 supported by the support ribs 28. This pressing contributes to dewatering of the web through both of the wires 10,20, but primarily through the upper wire 20 and is enhanced by the negative pressures $P_a$,$P_b$,$P_c$,$P_d$.

As shown in FIG. 2, a water flow $F_a$ enters from the space 26*a* below the compartment 22*a* through the duct 25*a* into the first compartment 22*a* in which the level of negative pressure $P_a$ is present. Similarly, from the rib section 26*b* placed below the compartment 22*b*, a water flow $F_c$ enters through the duct 25*b* into the second compartment 22*b*. Likewise, from the rib section 26*c* below the compartment 22*c*, a water flow $F_c$ is passed through the duct 25*c* into the compartment 22*c*. From the rib section 26*d* below the compartment 22*d*, a water flow $F_d$ is passed through the duct 25*d* into the compartment 22*d*.

Figure 1A:
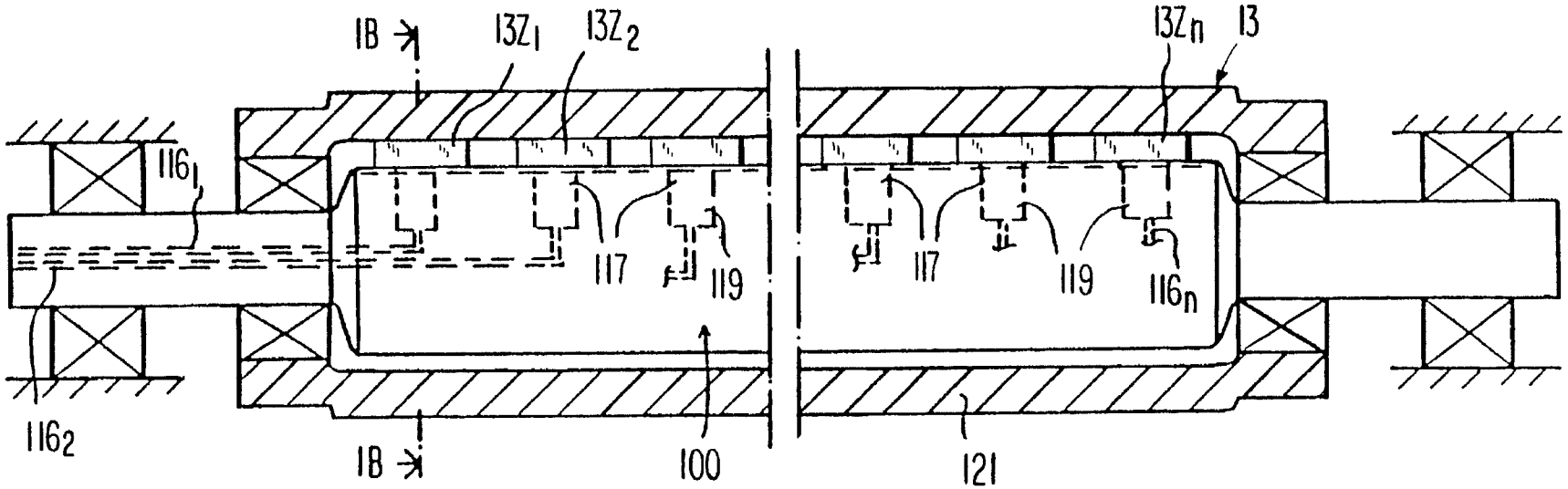
FIG. 1A is an axial cross-sectional view of the guide and forming roll used in accordance with the invention.
Figure 1B:
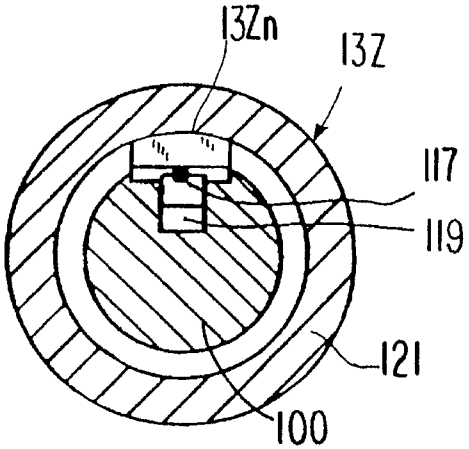
FIG. 1B is a sectional view taken along the line 1B—1B in FIG. 1A.

In the beginning of the twin-wire zone, after the gap G, when the upper wire 20 meets the stock layer $W_0$ that has been couched against the lower wire 10 in the single-wire zone 10*a*, a forming roll 13 is arranged inside the lower-wire loop and has a hollow face 13' or a corresponding smooth face. As shown in FIG. 2, pressure-loaded glide shoes 13Z are arranged inside the forming roll 13 and regulate the deflection of the mantle of the roll 13. Preferably, the glides shoes 13Z extend in the axial direction of the forming roll 13, i.e., glide shoes 13Z, . . . , 13$Z_n$ as shown in FIG. 1A, and are separately regulatable to provide any desired deflection profile via a conventional glide-shoe pressure loading system including pressure cylinders 117 each having an interior space 119 and a separate and individual pressurizing passage 16$_n$ (FIGS. 1A and 1B). In conjunction with the glide shoes 13Z, the roll 13 has a deflectable mantle 121 which revolves about a roll core 100 as is conventional in the art, whereby the pressure-loaded glide shoes 13Z constitutes means for varying and regulating the deflection of the mantle 121. When an adjustable-crown or variable-crown roll is used as the roll 13, its diameter $D_0$ is typically in the range of from about 400 mm to about 500 mm. As the forming roll 13, it is also possible to use a roll that has no crown variation, either a hollow-faced or a solid-faced roll, in which case, for example, in a machine of a width of 10 meters, $D_0$ would be from about 800 mm to about 1000 mm, so that the deflection of the forming roll 13 can be made sufficiently small. At the forming roll 13, the twin-wire zone has a very small curve sector a, which is selected in the range of from about 0° to about 5°, preferably from about 0° to about 2°. Even with a curve sector as small as this, sufficient transverse stabilization of the wires is achieved, but the sector a is so small that, in its area, no substantial dewatering takes place. Thus, the forming roll 13 produces dewatering mainly by the so-called effect of a table roll because of the negative pressure formed in the wedge space R at its trailing side.

At the forming roll 13, the fiber consistency $k_1$ of the stock layer $W_0$ is generally in the range from about 1% to about 3%, preferably in the range from about 1.5% to about 2.5%. After the MB unit 100, the fiber consistency $k_2$ of the stock layer is typically in the range from about 14% to about 19%, depending on the paper grade.

In the way described above, the stock web $W_0$ can be brought to the MB zone when sufficiently wet, such that, owing to the negative pressures $P_a, \ldots, P_d$ in the suction boxes 22, a sufficiently high dewatering through the upper wire 20 is achieved. In this manner, a substantially symmetric distribution of fillers and fines is formed in the paper. Owing to the symmetric distribution of fines and fillers, the paper produced can also be made such that both of its faces are symmetric and of equal printing properties.

Thus, in the area of the sets of ribs 28,33*a*,33,33*b* in the MB unit, water is drained primarily through the upper wire 20, so that the proportion of this draining is about 20% to about 40% of the overall dewatering proportion taking place in the MB zone. The length L of the MB zone, calculated from the first support rib 33*a* to the last support rib 33*c*, is of an order of about 1.5 m.

The examples provided above are not meant to be exclusive. Many other variations of the present invention would be obvious to those skilled in the art, and are contemplated to be within the scope of the appended claims.

We claim:

1. In a hybrid former in a paper machine including a lower wire guided in a loop and forming an initial single-wire portion of a forming zone, draining elements arranged in said lower-wire loop in said single-wire portion, wire-guide and draining elements arranged in said lower-wire loop after said single-wire portion, an upper wire guided in a loop by guide rolls, a breast roll arranged in said upper-wire loop for guiding said upper wire into contact with a web being carried on said lower wire to form a subsequent twin-wire portion of the forming zone following said single-wire portion, and a draining and forming unit arranged in said twin-wire portion, the improvement comprising a revolving guide and forming roll arranged at an initial part of said twin-wire portion and in contact with said lower-wire loop, said twin-wire portion being guided over said guide and forming roll such that an angle of contact between said lower wire and said guide and forming roll is from about 0° to about 5°, said draining and forming unit being arranged immediately after said guide and forming roll and comprising at least one pressure-loaded press unit arranged in one of said upper-wire loop or said lower-wire loop and at least one draining-chamber and support unit arranged in the other of said loops, said at least one press unit and said at least one draining-chamber and support unit comprising loading ribs and at least one draining chamber and being arranged to drain water from the web aided by negative pressure in said at least one draining chamber.

2. The former of claim 1, wherein said guide and forming roll has a smooth outer mantle, a diameter in a range from about 800 mm to about 1000 mm and does not include crown variation means.

3. The former of claim 1, wherein said guide and forming roll comprises a deflectable mantle and means for varying or regulating the deflection of said mantle, said guide and forming roll having a diameter in a range from about 400 mm to about 500 mm.

4. The former of claim 1, wherein said draining elements in said single-wire portion and the length of said single-wire portion are arranged such that the fiber consistency of the web as it arrives in said twin-wire portion at the location of said guide and forming roll is from about 1% to about 3%, whereby in said draining and forming unit, a sufficient amount of dewatering takes place through said upper wire to produce sufficient symmetry of the faces and of the distribution of fines and fillers in the web.

5. The former of claim 1, wherein said at least one press unit is arranged after said guide and forming roll in said lower-wire loop and said ribs in said at least one press unit are pressure-loaded ribs, said at least one draining-chamber and support unit being arranged in said upper-wire loop and further comprising a suction-deflector box arranged before said at least one draining chamber in the direction of travel of said upper wire.

6. The former of claim 5, wherein said at least one draining-chamber and support unit is arranged in said upper-wire loop and said ribs in said at least one draining-chamber and support unit being arranged opposite said pressure-loaded ribs in said at least one press unit.

7. The former of claim 1, wherein said ribs in said draining and forming unit guide said twin-wire portion with a relatively large curve radius whose center of curvature is at the side of said upper-wire loop, said curve radius being in a range from about 5 m to about 8 m.

8. The former of claim 1, wherein in the area of said guide and forming roll, water draining from the web takes place substantially exclusively toward a wedge space opened at a trailing side of said guide and forming roll by a table-roll effect.

9. The former of claim 1, wherein said at least one press unit is arranged after said guide and forming roll in said lower-wire loop and said at least one draining-chamber and support unit is arranged in said upper-wire loop, further comprising a first forming roll arranged after said draining and forming unit in said upper-wire loop, said first forming roll functioning to curve said twin-wire portion from a downward, inclined run to an upward, inclined run, and a forming shoe arranged after said first forming roll in said lower-wire loop, said forming shoe including a curved ribbed deck connected to a vacuum source, a second forming roll arranged after said forming shoe in said lower-wire loop, said second forming roll functioning to curve said twin-wire portion from an upward, inclined run to a downward, inclined run, and suction boxes arranged after said second forming roll in said lower-wire loop, a last one of said suction boxes in the direction of travel of said lower wire being arranged substantially opposite one of said guide rolls in said upper-wire loop such that in an area of said last suction box, said lower wire and the web are separated from said upper wire.

10. The former of claim 1, further comprising means defining a suction-deflector chamber arranged above said guide and forming roll and separated therefrom by an intermediate space, and a water drain duct arranged at a rear edge of said suction-deflector chamber, said water drain duct having a bottom portion including a deflector which constitutes a first one of said ribs in said support and draining unit.

11. The former of claim 1, wherein said single-wire portion of the forming zone is substantially horizontal and said twin-wire portion has a substantially horizontal direction of progress.

12. The former of claim 1, wherein said guide and forming roll comprises means for regulating the deflection of a mantle of said guide and forming roll.

13. The former of claim 12, wherein said regulating means comprise a plurality of pressure-loaded glide shoes arranged in an axial direction thereof and which are independently loaded.

14. The former of claim 1, wherein said guide and forming roll has an open, hollow face.

15. The former of claim 1, wherein said at least one draining-chamber and support unit comprises a plurality of successively arranged pressure compartments, a level of negative pressure in each of said pressure compartments being independently regulated.

16. The former of claim 1, further comprising means defining a suction-deflector chamber arranged above said guide and forming roll and separated therefrom by an intermediate space, said guide and forming roll being arranged in opposed relationship to at least a portion of said means defining said suction-deflector chamber.

17. The former of claim 1, wherein said twin-wire portion is guided over said guide and forming roll such that the angle of contact between said lower wire and said guide and forming roll is 0° whereby said lower wire is in tangential contact with said guide and forming roll.

18. The former of claim 1, wherein said twin-wire portion is guided over said guide and forming roll such that the angle of contact between said lower wire and said guide and forming roll is greater than 0°and less than or equal to about 5° whereby said lower wire is wrapped and curved about a sector of said guide and forming roll.

19. The former of claim 18, wherein the angle of contact between said lower wire and said guide and forming roll is less than about 2°.

20. The former of claim 1, wherein said forming roll comprises a variable-crown or adjustable-crown roll including a roll mantle and means for deflecting said roll mantle in a direction transverse to the running direction of the web to thereby cause the web to be profiled in the transverse direction.

* * * * *